United States Patent [19]

Kowal

[11] Patent Number: 4,762,100

[45] Date of Patent: Aug. 9, 1988

[54] INVERTED BUCKET TAPPET WITH IMPROVED SEAL AND VALVE STEM PAD

[75] Inventor: Steven J. Kowal, Prospect Heights, Ill.

[73] Assignee: Stanadyne, Inc., Windsor, Conn.

[21] Appl. No.: 928,556

[22] Filed: Nov. 10, 1986

[51] Int. Cl.[4] ..... F01L 1/24

[52] U.S. Cl. ..... 123/90.58; 123/90.56

[58] Field of Search ..... 123/90.58, 90.53, 90.55, 123/90.56, 90.57, 90.43, 90.46, 90.59

[56] References Cited

U.S. PATENT DOCUMENTS

| | | | |
|---|---|---|---|
| 2,874,684 | 2/1959 | Thompson | 123/90.55 |
| 3,521,608 | 7/1970 | Scheibe | 123/90.57 |
| 4,397,271 | 8/1983 | Garder | 123/90.58 |
| 4,590,899 | 5/1986 | Kowal et al. | 123/90.58 |
| 4,624,225 | 11/1986 | Kowal | 123/90.58 |
| 4,649,875 | 3/1987 | Mirone et al. | 123/90.55 |

*Primary Examiner*—Willis R. Wolfe, Jr.
*Assistant Examiner*—M. Macy
*Attorney, Agent, or Firm*—Kinzer, Plyer, Dorn, McEachran & Jambor

[57] ABSTRACT

A self-contained lash adjuster includes a generally cup-shaped follower having an end face and a lash adjuster cartridge assembly positioned within the follower. The cartridge assembly includes a body positioned against the follower end face and a reciprocally movable plunger within the body. There is a high pressure chamber between the plunger and the body, a plunger passage opening into the high pressure chamber and a check valve which controls fluid flow through the plunger passage. The plunger has an open end spaced from the high pressure chamber and there is a valve stem pad closing the plunger open end. An annular expandable seal member defines a reservoir about the cartridge assembly and is fastened at one end to the body and at the other end to the plunger. The seal member extends in part between the plunger and the valve stem pad. The plunger has openings therein in communication with the reservoir.

6 Claims, 1 Drawing Sheet

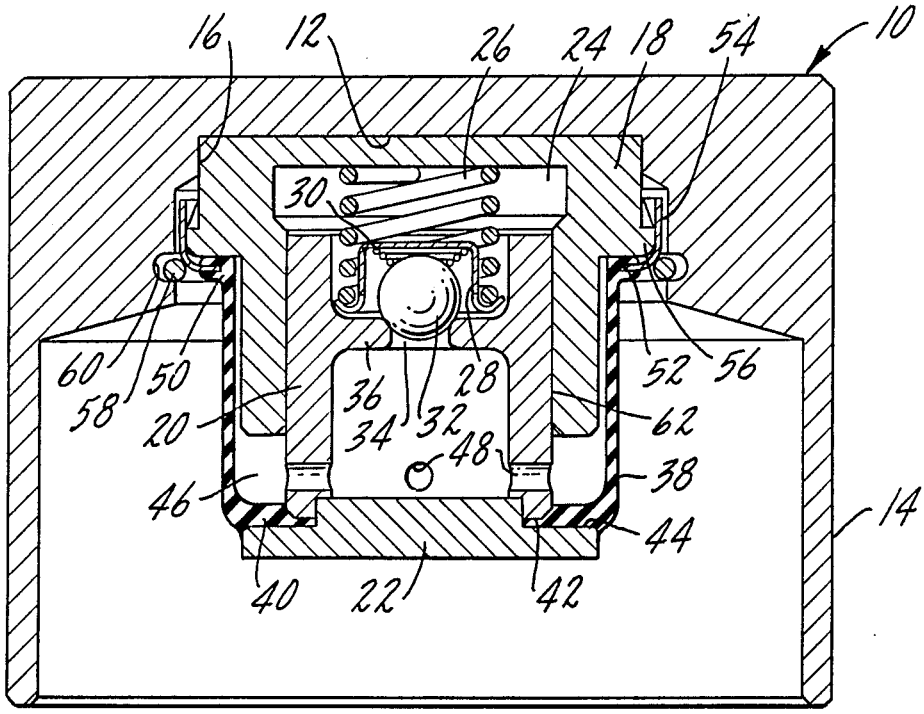
10
16
12
26
24
18
54
30
60
50
58
20
36
34
32
28
48
52
56
62
38
46
44
14
40
22
42

INVERTED BUCKET TAPPET WITH IMPROVED SEAL AND VALVE STEM PAD

SUMMARY OF THE INVENTION

The present invention relates to self-contained hydraulic lash adjusters and in particular to a self-contained lash adjuster in which there is a cylindrical seal forming a closed reservoir about the exterior of the lash adjuster cartridge assembly.

A primary purpose of the invention is a hydraulic lash adjuster in which an improved seal provides a self-contained reservoir for hydraulic fluid about the lash adjuster cartridge assembly.

Another purpose is a lash adjuster of the type described utilizing fewer parts than prior lash adjusters of similar utility.

Another purpose is a lash adjuster assembly lighter in weight than prior lash adjuster assemblies having the same utility.

Another purpose is a lash adjuster of the type described utilizing an expandable seal to provide a fluid reservoir about the lash adjuster cartridge assembly and in which there is a simply constructed reliably operable attachment for the seal to the lash adjuster cartridge assembly.

Other purposes will appear in the ensuing specification, drawing and claims.

BRIEF DESCRIPTION OF THE DRAWINGS

The invention is illustrated in the attached axial section through the preferred embodiment of the invention.

DESCRIPTION OF THE PREFERRED EMBODIMENT

U.S. Pat. No. 4,590,899, assigned to the assignee of the present application, discloses a flexible seal in a self-contained lash adjuster in which the seal defines a fluid reservoir in communication with the lash adjuster high pressure chamber. In the '899 patent the seal is fixed to the movable body forming one element of the lash adjuster cartridge assembly and to the shell which mounts the cartridge assembly within the follower. The seal expands and contracts during operation of the lash adjuster as fluid is moved between the high pressure chamber and the reservoir during normal engine operation.

The present invention provides an improved seal and method of attaching the same to the lash adjuster cartridge assembly.

One of the advantages of a self-contained lash adjuster is that it prevents aerated oil reaching the high pressure chamber in the adjuster, thus reducing the possibility of a noisy tappet or lash adjuster with consequent malfunction of the engine. However, in such a self-contained lash adjuster, it is necessary that the reservoir of hydraulic fluid be permanently and satisfactorily sealed so as to prevent loss of fluid. The present invention provides an improved type of seal which is firmly attached at its opposite ends to the lash adjuster cartridge assembly so that the fluid reservoir maintains its integrity over the long period of time and long mileage requirements placed on lash adjusters in state-of-the-art engines.

The lash adjuster will be positioned axially above the engine valve and immediately below an overhead cam. The lash adjuster disclosed herein is specifically designed for use in small efficient internal combustion engines utilizing overhead cams.

In the drawing, the lash adjuster follower is indicated generally at 10 and is of a cup-shaped configuration and has an interior end face 12 and an exterior wall 14. There is a recess 16 at end face 12 within which is positioned the lash adjuster cartridge assembly.

The lash adjuster cartridge assembly includes a body 18 which is positioned within and confined by recess 16 and a plunger 20. The plunger reciprocates within body 18 and has an open end which is closed by a valve stem pad 22.

Positioned between plunger 20 and body 18 is a high pressure chamber 24 within which is positioned a coil spring 26 which biases the plunger away from or to a position extended from body 18. Spring 26 supports a retainer 28 positioned within the high pressure chamber, which retainer supports and positions a small coil spring 30 urging a check valve in the form of a ball 32 toward a position closing passage 34 formed in an intermediate wall 36 of the plunger.

A cylindrically-shaped seal 38 is positioned about the cartridge assembly described and has an inwardly-directed flange 40 which extends between valve stem pad 22 and an end surface 42 of plunger 20. Flange 40 of seal 38 is compressed between the valve stem pad and the end of the plunger and is bonded to the valve stem pad by a suitable adhesive. Valve stem pad 22 has a peripheral recess 44 which provides a flat surface of substantial area for bonding of the seal to the valve stem pad.

Seal 38 defines a reservoir 46 which is inside of the seal and exterior of the cartridge assembly. Reservoir 46 is in communication with the interior of the plunger through a plurality of passages 48 which extend through the plunger adjacent, but spaced from, valve stem pad 22. Thus, reservoir 46 is in communication with the interior of the plunger and with high pressure chamber 24 through plunger passage 34.

As described, one end of seal 38 is attached to the valve stem pad and to the plunger. The opposite end of seal 38 is attached to cartridge assembly body 18. Seal 38 has an outwardly extending flange 50 having a groove 52 which receives one end of a thin flexible annular member 54. The construction described consisting of annular flexible member 54 and the outwardly extending projection 56 of body 18 in combination form a connection much like the conventional bottle cap which fits over the end of a bottle.

The cartridge assembly, which includes seal 38, can be inserted as a unit into recess 16 in follower 10 and held in position therein by a retaining ring 58 which is positioned within a groove 60 in the follower. The groove and retaining ring are adjacent and bear against flexible member 54.

The lash adjuster assembly is compact, lightweight and has a minimum number of parts. The cartridge assembly consisting of the body and plunger and the seal which is attached thereto forming the reservoir exteriorly of the cartridge assembly are held in position within the follower by a retaining ring. The valve stem pad which functions during normal engine operation to contact the engine valve also functions as a means for attaching one end of the reservoir forming seal to the cartridge assembly.

When the plunger moves reciprocally relative to the body during normal engine operation, hydraulic fluid will pass from the high pressure chamber to resevoir 46 and then back into the high pressure chamber. When the plunger is in the extended position shown, the high pressure chamber is at its maximum size and fluid from the reservoir will be in the chamber. When the body moves to a bottomed position, fluid will be forced from the high pressure chamber between the exterior of plunger 20 and the interior of body 18 along interface 62 into the reservoir which will cause the reservoir seal 38 to expand. Thus, seal 38 must be formed of a material which is expandable in order to accomodate the transfer of fluid from the high pressure chamber to the reservoir. The material also must have sufficient resiliency to urge the fluid from the reservoir back through plunger passages 48 and passage 34 to the high pressure chamber. In addition, the chemical characteristics of the seal are important, as the seal must be resistant to the silicone components normally found in hydraulic fluids. A material sold under the trademark VAMAC has been found to be one satisfactory material for the seal.

Whereas the preferred form of the invention has been shown and described herein, it should be realized that there may be many modifications, substitutions and alterations thereto.

The embodiments of the invention in which an exclusive property or privilege is claimed are defined as follows:

1. A self-contained lash adjuster including a generally cylindrical cup-shaped follower having an end face, a lash adjuster cartridge assembly within said follower, said cartridge assembly including a body positioned against said follower end face and a reciprocally movable plunger within said body, a high pressure chamber between said plunger and body, a plunger passage opening into said high pressure chamber, a check valve controlling fluid flow through said plunger passage, said plunger having an open end spaced from said high pressure chamber, a valve stem pad closing said plunger open end, and an annular expandable seal member extending about said cartridge assembly and attached at one end to said body and at the other end to said plunger and extending in part and compressed between said plunger and valve stem pad, said seal member defining a reservoir exteriorly of said cartridge assembly, said plunger having openings therein in communication with said reservoir.

2. The lash adjuster of claim 1 further characterized in that said annular seal is bonded to said valve stem pad.

3. The lash adjuster of claim 1 further characterized in that said follower has a recess adjacent said end face, with said cartridge assembly body being positioned within said recess, and a retaining ring holding said cartridge assembly within said recess.

4. The lash adjuster of claim 3 further characterized in that said annular seal is fastened to said body inside of said retaining ring.

5. The lash adjuster of claim 4 further characterized in that the means for fastening said seal member to said body includes an outwardly extending projection on said body and a flexible member extending about said projection and attached to said seal member.

6. The lash adjuster of claim 5 further characterized in that said retaining ring is in contact with said flexible member on the opposite side of said body projection to maintain and attach said body to said follower.

* * * * *